US007565715B2

(12) United States Patent
Harper et al.

(10) Patent No.: US 7,565,715 B2
(45) Date of Patent: Jul. 28, 2009

(54) CLEANING IMPLEMENT

(75) Inventors: Richard Michael Harper, Cincinnati, OH (US); James Edward Poland, Park Hills, KY (US); Douglas Michael McGahan, Bethel, OH (US); Gregory Clegg Spooner, Hong Kong (CN); Caroline Marie Flagiello, San Francisco, CA (US); Margrethe Elizabeth Koshland, San Francisco, CA (US); Anthony Piazza, Palo Alto, CA (US); John Philip Stoddard, Ben Lomond, CA (US); Pontus Kaj Bjorn Wahlgren, London (GB)

(73) Assignee: The Procter & Gamble Company, Cincinnati, OH (US)

( * ) Notice: Subject to any disclaimer, the term of this patent is extended or adjusted under 35 U.S.C. 154(b) by 106 days.

(21) Appl. No.: 11/403,396

(22) Filed: Apr. 13, 2006

(65) Prior Publication Data

US 2006/0230567 A1 Oct. 19, 2006

Related U.S. Application Data

(60) Provisional application No. 60/671,018, filed on Apr. 13, 2005.

(51) Int. Cl.
*A47L 13/10* (2006.01)

(52) U.S. Cl. ..... 15/228; 15/231; 15/147.2

(58) Field of Classification Search ..... 15/228, 15/231, 147.2
See application file for complete search history.

(56) References Cited

U.S. PATENT DOCUMENTS

| | | | | |
|---|---|---|---|---|
| 3,991,431 | A * | 11/1976 | Thielen | 15/147.2 |
| 6,579,023 | B2 * | 6/2003 | Kunkler et al. | 401/138 |
| 2001/0046417 | A1 | 11/2001 | Kunkler et al. | |
| 2002/0184726 | A1 | 12/2002 | Kingry et al. | |
| 2006/0010627 | A1 * | 1/2006 | Godfroid et al. | 15/104.8 |

FOREIGN PATENT DOCUMENTS

EP 1050237 A3 5/2001

OTHER PUBLICATIONS

PCT International Search Report—Dated Oct. 31, 2006—4 pages.

* cited by examiner

*Primary Examiner*—Dung Van Nguyen
(74) *Attorney, Agent, or Firm*—Thibault Fayette; Mark A. Charles; Larry L. Huston

(57) ABSTRACT

A cleaning implement is provided for cleaning surfaces with a cleaning substrate. The cleaning implement includes a handle connected via a universal joint to a support head. The support head includes a substantially transparent top piece having a plurality of protruding and recessed region which diffract light to create visible shadow and bright zones.

5 Claims, 9 Drawing Sheets

CLEANING IMPLEMENT

CROSS REFERENCE TO RELATED APPLICATION

This application claims the benefit of U.S. Provisional Application No. 60/671,018, filed Apr. 13, 2005.

TECHNICAL FIELD OF THE INVENTION

The present invention relates to the field of cleaning tools and more particularly cleaning implements used in combination with a disposable cleaning substrate which are useful for cleaning hard and/or compressible surfaces such as floors, walls, ceilings, rugs, carpets, upholstery and the like.

BACKGROUND OF THE INVENTION

The literature is replete with cleaning tools used in combination with a disposable cleaning substrate in order to clean surfaces such as ceramic tile floors, hardwood floors, counter tops, rugs, carpets, upholstery and the like. These cleaning tools typically include a handle connected to a support head. The support head of modern cleaning tools include a top piece having a rectangular shape and which is connected to the lower end of a handle, and a compressible lower piece attached to the bottom of the top piece. This compressible lower piece is in direct contact with the disposable substrate during the cleaning operation. The cleaning substrate can be in the form of a sheet or pad which can include a nonwoven material and which can be either dry or premoistened with a cleaning composition. The compressible portion can be made of a substantially non-absorbent synthetic material. The top piece is typically made of a plastic including a dye, which provides a uniform color to the plastic. The top piece of the cleaning implement is opaque in the sense that a user cannot see the compressible portion located underneath the rigid portion. The top piece of these cleaning implement also has a substantially constant thickness. As a user uses the handle to move the support head to clean a surface in the direction he or she wishes, the user sees the support head from varying angles during the cleaning operation. The top piece of these cleaning implements can have a relatively "blend" appearance in the sense that the visual impression they provide to the user does not vary depending on the angle a user looks at the top piece.

In order to make the cleaning operation more "fun" or enjoyable for the user, it is one object of the invention to provide a support head whose appearance or visual impression changes during the cleaning operation.

The compressible lower piece of the support head is typically larger in width and/or length than the top piece in order to prevent the top piece from accidentally getting in contact with and potentially damaging the surface being cleaned. These implements allow the user to safely wipe the surface being cleaned with a cleaning substrate pressed against the surface being cleaned by the compressible lower piece while being attached to the support head. More functional cleaning substrates described in patent application Ser. No. 10/958,791 and Ser. No. 10/958,852 both to Pung et al., filed Oct. 8, 2004, and assigned to The Procter & Gamble Company, allow a user not only to clean a surface with the side of the cleaning substrate that is pressed against the surface being cleaned by the bottom compressible portion, but also to use the portion of the substrate adjacent to the top piece by rotating or flipping the support head. As the top piece of the support head is used to press the substrate against a surface to be cleaned, the hardness of the support plate may result in accidental damage to the surface being cleaned. In addition, in the event the surface being cleaned is not substantially flat (i.e. includes bumps, grooves, grout lines and the likes) the top piece cannot conform to the surface or topography variations found in the surface being cleaned.

It is therefore another object of the invention to provide a support head allowing a user to use the portions of the cleaning substrate that are adjacent either to the bottom or top surface of the support head.

The handle of modern cleaning implement is typically connected to the support head via a universal joint. The universal joint can include at least one but preferably two rotational axis allowing the support head to swivel during use. The universal joint can include a yoke portion whose lower end is rotatably connected to the support head directly or indirectly. The yoke portion can be made of plastic. The upper end of the yoke can be connected to the lower end of a handle. The handle can be made of any suitable material, for example metal or plastic that is capable of enduring the force applied by a user during the cleaning operation. Although plastic materials are know that are "strong" or sturdy enough to endure the forces applied by a user, it is found that users do not generally perceive handles made of plastic as being as strong as handles made for example of aluminum. It is also found that the cleaning efficacy of a cleaning implement is at least partially related to the amount of force that is applied by the user during the cleaning operation and that the cleaning efficacy of the implement is increased when a greater amount of force is applied by a user during cleaning. As a result of the user's "negative" perception of a cleaning implement whose yoke and/or handle is made of plastic, he or she may not apply as much force as he or she would apply if the yoke and handle were both made of metal.

It is therefore another object of the invention to provide a cleaning implement whose yoke and/or handle is made of a plastic material while improving the user's perception as to the yoke/handle assembly strength or sturdiness.

Modern cleaning implements can include a hand-grip portion whose lower end is connected to the upper end of the handle. This hand-grip allows a user to grab and maneuver the implement. As the handle is rotatably connected to the support head, the hand-grip may bump against a wall if the user accidentally releases the hand-grip. The upper or proximal end of the hand-grip may damage a wall in particular a wall covered with paint and/or made of dry wall, when it is accidentally released by the user and falls towards the wall.

It is therefore another object of the invention to provide a hand-grip capable of to minimizing potential damage to a wall if the hand-grip is accidentally released by a user.

SUMMARY OF THE INVENTION

In one embodiment, the invention is directed to a support head for a cleaning implement, having a top piece comprising at least one protruding region and one recessed region wherein the protruding region and the recessed region are made of at least one of a substantially translucent material and a substantially transparent material such that the protruding region produces a visible shadow zone and a visible bright zone on a surface located underneath the top piece when light passes through the protruding region.

In another embodiment, the invention is directed to a support head for a cleaning implement, having a top piece comprising a first protruding region having a peak and a thickness, the protruding region being adjacent to a recessed region having a trough and a thickness wherein the thickness of the protruding region at the peak is greater than the thickness of the recessed region at the trough, wherein the protruding region and recessed second region are made of at least one of a substantially translucent material and a substantially transparent material comprising a dye such that the first region appears distinctively darker than the recessed region when the top piece is exposed to a source of light.

In another embodiment, the invention is directed to a support head for a cleaning implement, having a top piece having a leading region and a trailing region and a lower piece having a bottom region and an upper leading region wherein the lower piece is attached to the top piece such that the leading region of the top piece is located in between the bottom region and the upper leading region of the lower piece and wherein the lower piece is made of a substantially non-absorbent material.

In another embodiment, the invention is directed to a cleaning implement having a support head and a longitudinal member operably connected to the support head, the longitudinal member having an outer surface and a cavity defining an inner surface of the longitudinal member, wherein the longitudinal member is made of a substantially transparent material and wherein at least a portion of the inner surface is at least one of substantially translucent and opaque such that the appearance of the inner surface differs from the appearance of the outer surface and wherein the inner surface is visible through said substantially longitudinal member.

In another embodiment, the invention is directed to a cleaning implement comprising a support head and a longitudinal member operably connected to the support head, the longitudinal member having an outer surface and a cavity defining an inner surface of the longitudinal member, wherein the longitudinal member is made of a substantially transparent material and wherein at least a portion of the cavity comprises at least one of a substantially translucent material and an opaque material, wherein the substantially translucent or opaque material does not provide any significant structural reinforcement to the longitudinal member and wherein the appearance of the substantially translucent or opaque material visually differs from the appearance of the outer surface In another embodiment, the invention is directed to a handle for a cleaning implement having a handle section, a hand-grip portion operably connected to one end of the handle section and a ring portion flexibly connected to an upper end of the hand-grip portion such that the ring portion is moveable relative to the hand-grip portion when a force is applied to the ring portion.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

All documents cited herein are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification and Claims, are by weight unless otherwise specified and all numerical limits are used with the normal degree of accuracy afforded by the art, unless otherwise specified.

While not intending to limit the utility of the invention herein, it is believed that a brief description of its use will help elucidate the invention.

Figure 1:
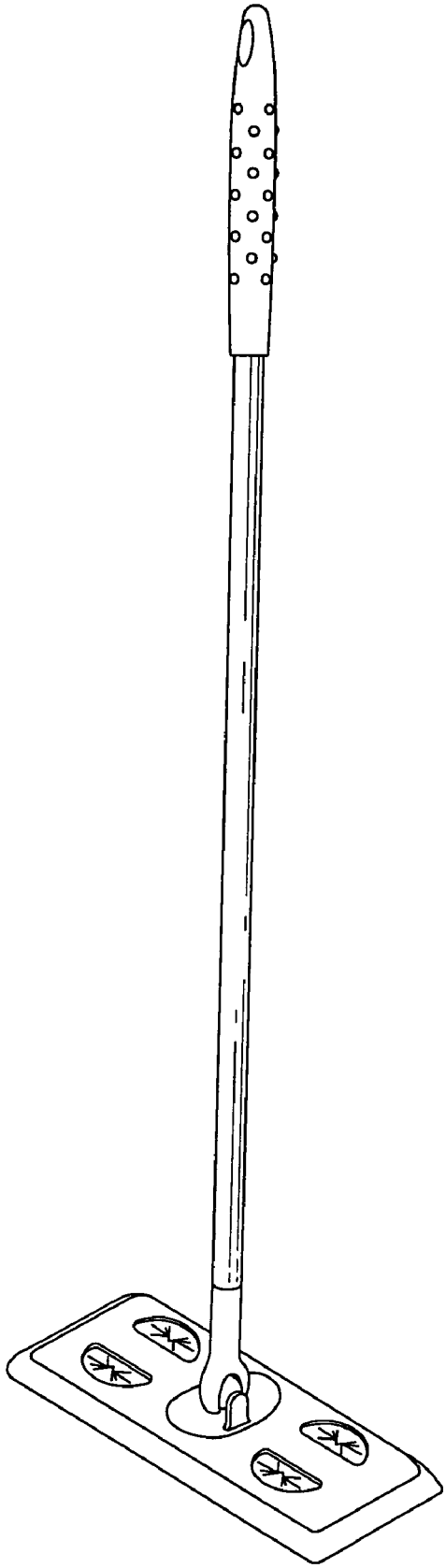
FIG. 1 is an isometric view of a "traditional" cleaning implement.

Modern cleaning implements employ disposable cleaning substrates such as sheets or absorbent pads, which are releasably affixed to the support head of the implement, and which can conveniently be discarded and replaced after soiling. These cleaning implements have a handle which is rotatably connected to a support head. The support head is typically substantially rectangular and includes a top rigid portion which is rotatably connected to the lower end of the handle, as well as, a compressible lower piece (or "bumper" pad) that is attached to the top rigid portion of the support head. The compressible lower piece minimizes the risk that the surface being cleaned or objects located on this surface may be damaged during the cleaning operation. The cleaning substrate can be wrapped around the support head and attached to slitted structures located on the top rigid portion such as the one disclosed in U.S. Pat. No. 6,651,290 to Kingry et al. issued Nov. 25, 2003 and assigned to The Procter & Gamble Company. One example of such a "modern" cleaning implement is the SWIFFER® cleaning implement sold by The Procter & Gamble Company which is shown is FIG. 1. This type of implement is particularly adapted to clean large flat surfaces such as floors, walls, ceiling, carpets or rugs.

The top piece is typically made of a plastic including a dye, which provides a uniform color to the plastic. The top piece of the cleaning implement is typically opaque in the sense that a user cannot see the compressible portion located underneath the rigid portion. The top piece of these cleaning implement also has a substantially constant thickness. As a user uses the handle to move the support head to clean a surface in the direction he or she wishes, the user sees the support head from varying angles during the cleaning operation. The top piece of these cleaning implements can have a relatively "blend"

appearance in the sense that the visual impression they provide to the user does not vary depending on the angle a user looks at the top piece.

It is found that the user's experience or overall impression of the use of a cleaning implement can be made more "fun" or enjoyable for the user, when the appearance or visual impression of the support head changes during the cleaning operation.

Figure 2:
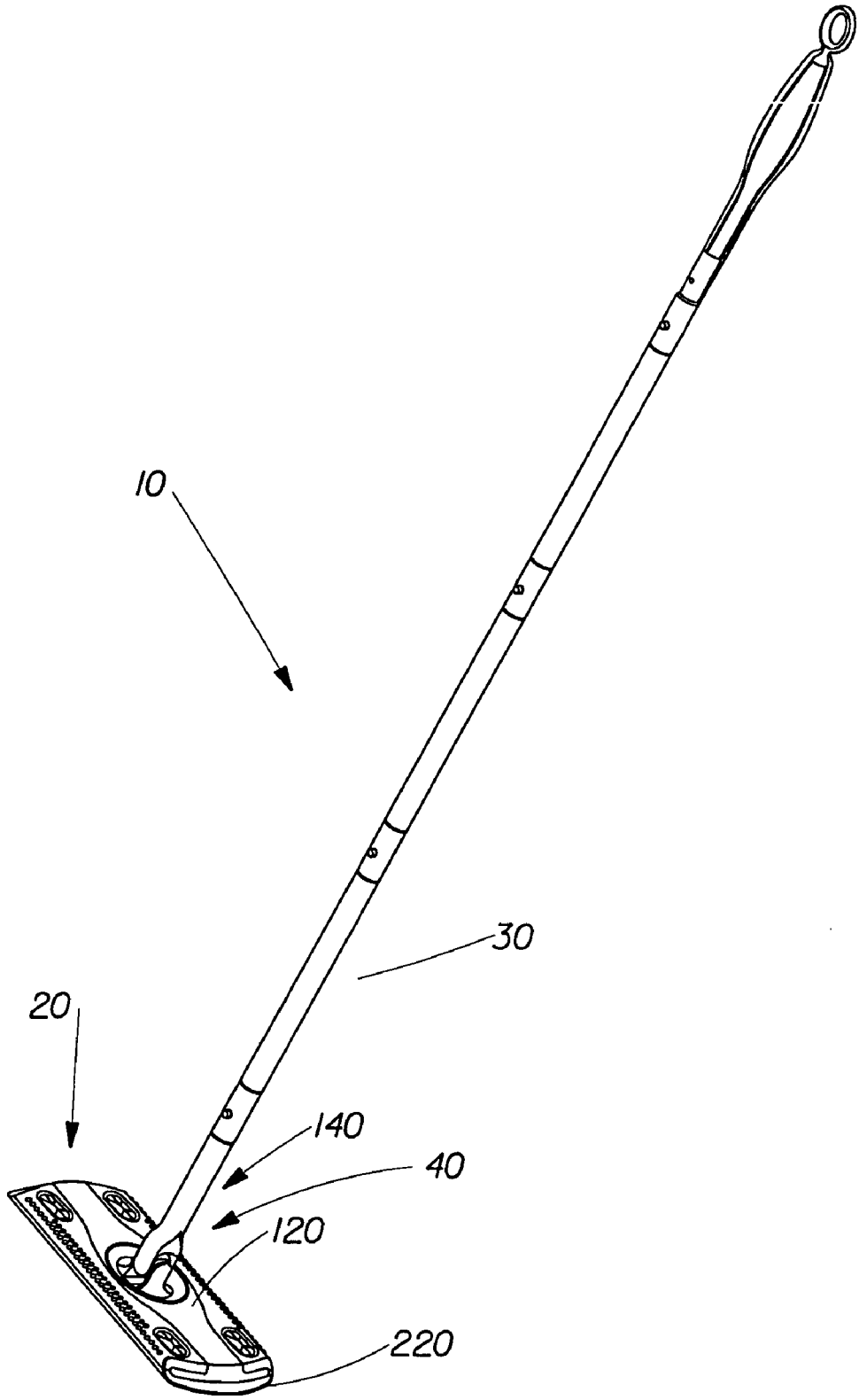
FIG. 2 is an isometric view of a cleaning implement of one embodiment of the present invention.

FIG. 2 shows a cleaning implement 10 according to one embodiment of the invention.

In one embodiment, the cleaning implement 10 includes a support head 20 that can be connected, preferably rotatably connected to the lower end of a handle 30. The support head 20 includes a top piece 120 whose appearance or visual impression changes depending on the angle at which a user looks at the top piece.

In one embodiment, at least a portion of the top piece 120 is made of a substantially translucent material, preferably a substantially transparent material. By "substantially transparent translucent" it is meant any material allowing at least some light to go through the translucent material. The substantially translucent material can have a light transmittance greater than about 0%, preferably greater than about 10%, more preferably greater than about 25% and even more preferably greater than about 50%. By "substantially transparent material" it is meant any material allowing a person to discern visually objects located behind the substantially transparent material under normal day light conditions. A substantially transparent material can have light transmittance greater than about 90%, preferably greater than about 92%, more preferably greater than about 94% and even more preferably greater than about 96%. An opaque material has a a light transmittance of 0%. The substantially transparent elements can be made of one or more amorphous non-crystalline plastics which do not have any internal features which may scatter light and create haziness or opacity. Other crystalline polymers can be transparent when the size of the crystallites in the material are below the wavelength of visible light. Non-limiting examples of substantially translucent and transparent materials include glass, Acrylonitrile Butadiene Styrene, Polyethylene Terephtalate Glycol, polycarbonate, polypropylene, high impact polystyrene and mixtures thereof. One skilled in the art will understand that other material can be used and still provide the same benefits.

Figure 3:
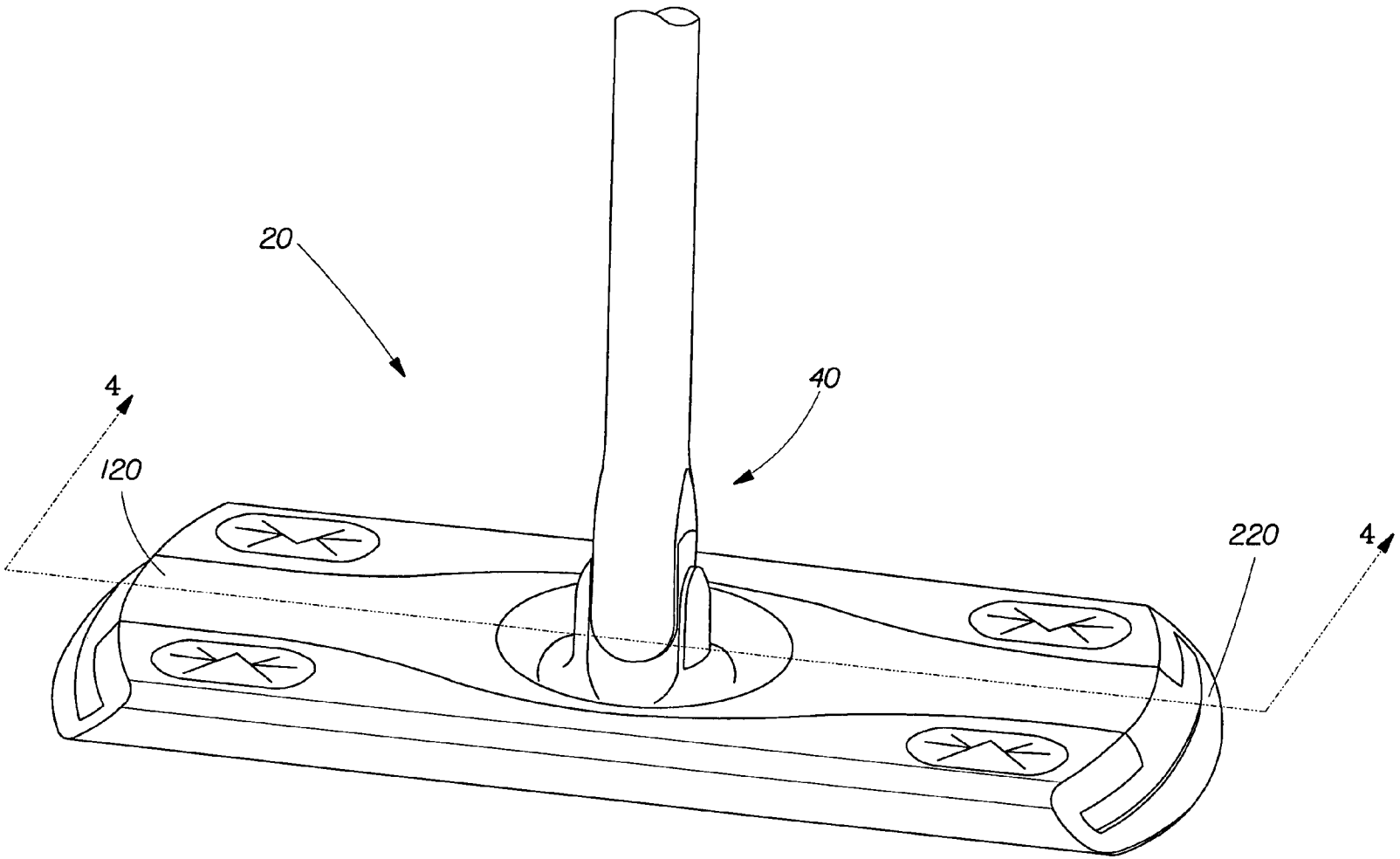
FIG. 3 is an enlarged view of the support head of the cleaning implement shown in FIG. 2.

FIG. 3 shows an enlarged view of the support head 20.

In one embodiment, the support head 20 can include a lower piece 220 that is attached to the top piece 120 such that a user can discern the lower piece 220 through the top piece 120 made of a substantially transparent material. At least a portion of the lower piece can be made of a substantially compressible material. In a preferred embodiment, the whole lower piece is made of a substantially compressible material. By "substantially compressible material" it is meant any material capable of some deformation during normal usage conditions of the cleaning implement. In one embodiment the material used to make at least a portion or the whole lower piece is substantially elastic in the sense that it returns to its original shape when pressure ceases to be applied to the material.

In one embodiment, the material used to make at least a portion or the whole lower piece 120 is made of a substantially compressible material having a durometer of between about 5 shore A and about 80 Shore OOO, preferably between about 20 Shore A and about 50 Shore OOO, more preferably between about 25 Shore A and about 35 Shore OOO. In one embodiment, the material used to make at least a portion or the whole lower piece 120 is made of a substantially compressible material having a durometer of between about 5 and about 60, preferably between about 20 and about 35, more preferably between about 25 and about 30 Shore A. In one embodiment, the material used to make at least a portion or the whole lower piece 120 is made of a substantially compressible material having a durometer of between about 5 and about 80, preferably between about 10 and about 50, more preferably between about 25 and about 35 Shore OOO.

In one embodiment, the substantially compressible material used to make the portion or the entire lower piece is substantially absorbent. Non-limiting examples of substantially absorbent material include natural or synthetic sponge, an open-cell structure capable of retaining a liquid by capillarity and woven or nonwoven fibrous material.

In another embodiment, the substantially compressible material used to make the portion or the entire lower piece can be substantially non-absorbent. By "substantially non-absorbent material", it is meant that the weight of water absorbed by a sample material after 5 minutes of full immersion in water without undue deformation or squeezing of the sample material is less than about 50%, preferably less than about 30%, more preferably less than about 20% and even more preferably less than about 10% and most preferably less than about 5% by weight of the sample material. Among other benefits, since the cleaning implement is used with a disposable cleaning substrate, the majority of the dirt removed from the surface being cleaned is trapped into the disposable substrate. As a result, a residual amount of dirty solution is left of the substantially non-absorbent lower piece after the cleaning operation, and this residual amount is easily rinsed off with water. Consequently, the cleaning implement provides a hygienic/sanitary way to clean surfaces as opposed to conventional sponges.

Non-limiting examples of suitable compressible and substantially non-absorbent material include ethylene vinyl acetate foam, Polyurethane foam, Polyethylene foam, and any mixtures thereof.

One skilled in the art will understand that other elements can be added in between the top and lower pieces 120, 220 such that a user can discern these elements and still provide the same benefits.

Figures 4A, 4B:
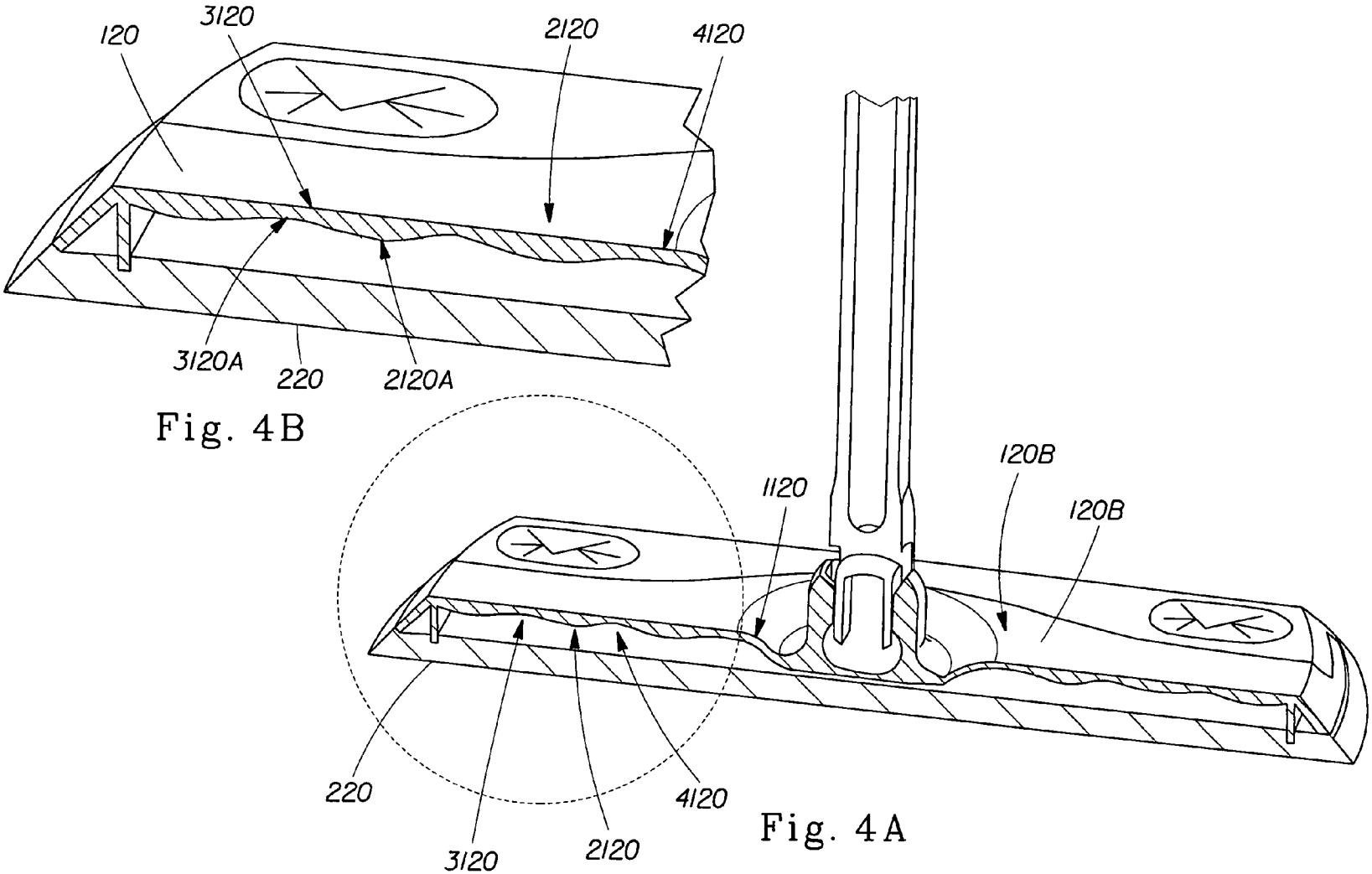
FIG. 4A is an isometric cross-sectional view of the support head of FIG. 3.
FIG. 4B is an enlarged area of the support head of FIG. 4A.

FIGS. 4A, and 4B show a cross-section of the support head 20 taken along the line 4—4.

In one embodiment, the top piece 120 can include at least one curved region 1120 having a substantially continuous and curved cross-sectional shape. Without intending to be bound by any theory, it is believed that the substantially continuous and curved cross-sectional shape of at least a substantially transparent portion of top piece 120 causes light to be diffracted when light goes through this curved region. The light being diffracted generates a visible "shadow" zone and a visible "bright" zone on the surface located underneath the top piece 120, which is discernable by a person.

By "visible 'shadow' zone", it is meant the area underneath the top piece 120 having a lower light intensity (due to the light diffraction) than the light intensity created by a flat substantially transparent material.

By "visible 'bright' zone", it is meant the area underneath the top piece 120 having a greater light intensity (due to the light diffraction) than the light intensity created by a flat substantially transparent material.

As a user moves the support head 20 across a surface being cleaned, and the angle at which a user looks at the support head varies, the "shadow" zone and "bright" zone appear to increase or diminish in size and intensity.

In one embodiment, the curved region 1120 can have a substantially constant thickness. In another embodiment, the curved region 1120 can have a thickness which varies (i.e. increases or decreases) along the curvature of the curved region.

In one embodiment the top piece 120 includes a plurality of curved regions generating visually distinct "shadow" zones and "bright" zones.

In one embodiment, the top piece 120 can have at least a first protruding region 2120 having a peak 2120A and a first recessed region 3120 having a trough 3120A.

It will be understood that the peak 2120A is the point on the protruding region where the thickness of the protruding region is the greatest.

It will also be understood that the trough 3120A is the point on the recessed region where the thickness of the recessed region is the smallest.

In one embodiment, the thickness at the peak of the protruding region 2120 taken along the Z axis is greater than the thickness at the trough of the recessed region 3120 taken along the Z axis.

In one embodiment, the thickness at the peak of the protruding region is between about 0.75 mm and about 25 mm, preferably between about 1 mm and about 10 mm, more preferably between about 3 mm and about 5 mm. In one embodiment, the thickness at the trough of the recessed region is between about 0.5 mm and about 19 mm, preferably between about 0.75 mm and about 10 mm, more preferably between about 1 mm and about 3 mm.

In one embodiment, the thickness differential between the peak of the protruding region and the trough of the recessed region is at least about 0.25 mm, preferably at least about 0.5 mm, more preferably at least about 1 mm, even more preferably at least about 2 mm, most preferably at least about 3 mm. In one embodiment the thickness differential between the peak of the protruding region and the trough of the recessed region is less than about 50 mm, preferably less than about 30 mm, more preferably less than about 20 mm, even more preferably less than about 10 mm. By "thickness differential" it is meant the difference between the thickness measured at the peak of the protruding region 2120 and the thickness measured at the trough of the recessed region 3120.

In one embodiment, the ratio of the thickness at the peak of the protruding region 2120 to the thickness at the trough of the recessed region 3120 is greater than about 1:1, preferably between about 1.1:1 and about 20:1, more preferably between about 1.2:1 and about 10:1, even more preferably between about 1.3:1 and about 5:1 and most preferably between about 1.5:1 and about 2.5:1. In one embodiment, the thickness of the substantially transparent portion of the top piece 120 gradually and continuously decreases between the peak of a protruding region 2120 and the trough of an adjacent recessed region 3120. By "gradually and continuously decreases," it is meant that the outer contour of the protruding region is substantially smooth between the peak of a protruding region and the trough of an adjacent recessed region.

In one embodiment, the top piece 120 includes a second recessed region 4120 such that the first protruding region 2120 is located in between the first and second recessed regions 3120, 4120 and such that the thickness of the protruding region is greater than the thickness of the second recessed region. In one embodiment, the thickness of the second recessed region is substantial equal to the thickness of the first recessed region and the thickness of the top piece 120 gradually decreases between the first protruding region 2120 and the second recessed region 3120. Without intending to be bound by any theory, it is believed that a substantially transparent protruding region deflects light and generates a "shadow" zone and a "bright zone as previously discussed.

In one embodiment, the top piece 120 of the support head 20 includes a plurality of protruding regions and recessed regions such that two consecutive protruding regions are separated by a recessed region.

Each of the protruding regions can have a peak where the thickness of the protruding region is the greatest. In one embodiment, the peak to peak distance between the peaks of two adjacent protruding regions is between about 1 mm and about 200 mm, preferably between about 2 mm and about 100 mm, more preferably between about 5 mm and about 50 mm.

Figure 4C:
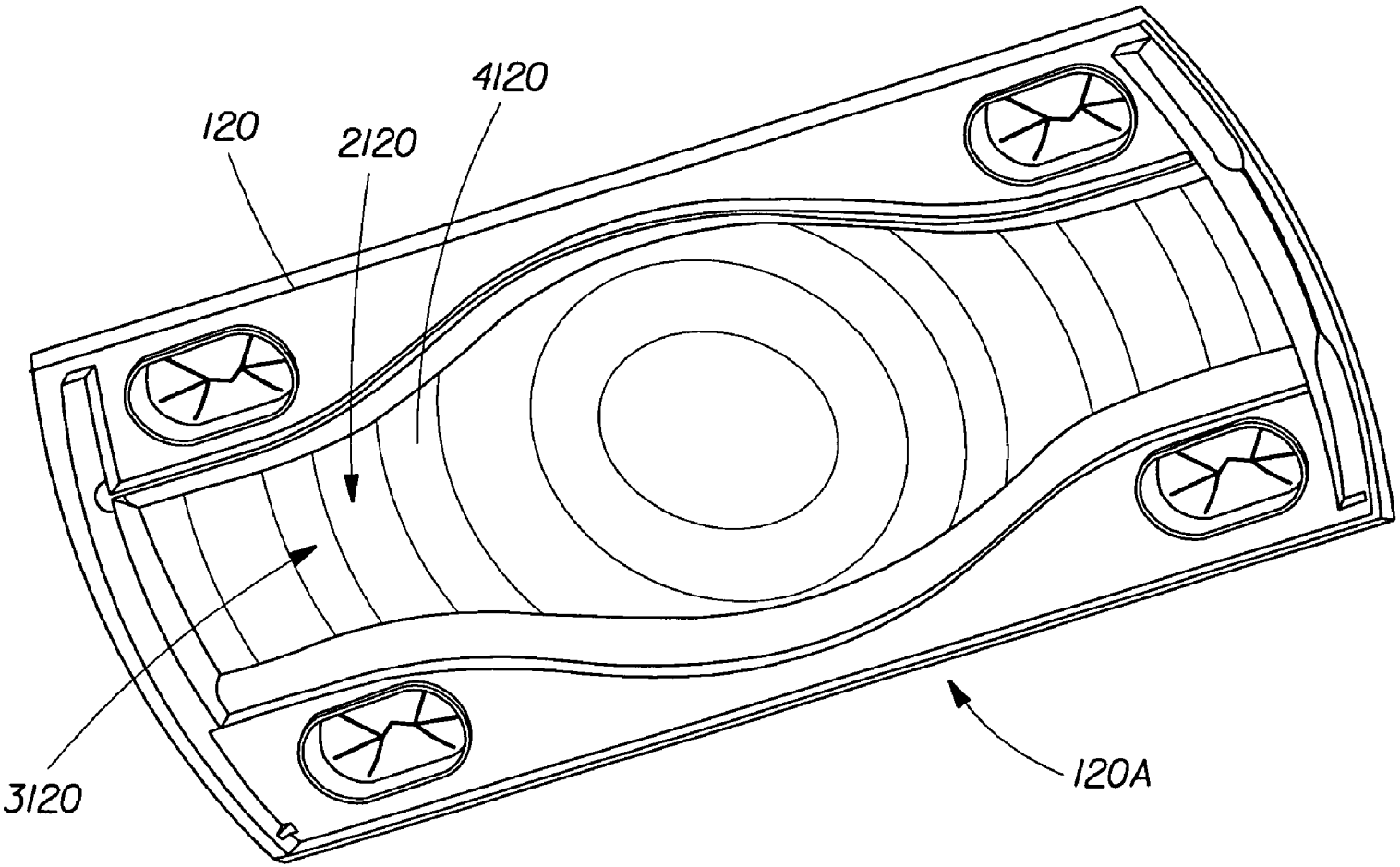
FIG. 4C is an isometric bottom view of the top piece of a support head.

FIG. 4C shows the inner surface 120A of a top piece 120 (where the lower piece 220 is not shown for clarity) having a plurality of protruding regions and recessed regions as previously described.

In one embodiment, a protruding region can extend in the X-Y dimension to create a pattern which can have any desired geometric shape. In a preferred embodiment, the protrusion has a substantially arc or circular shape. It will be appreciated that the previously discussed protruding regions and recessed regions can be located on the inner surface 120A of the top piece 120, on the outer surface 120B of the top piece 120 or alternatively on both the inner and outer surfaces of the top piece.

When at least one protruding region is located on the inner surface 120A of the top piece 120, the peak of this protruding region can be in contact with the lower piece 220 in order to apply pressure to the lower piece while creating the desired visual effect.

In one embodiment, the peak of at least one protruding region located on the inner surface 120A does not contact the lower piece 220. In one embodiment, the vertical distance between the peak of a protruding region and the lower piece 220 is at least about 1 mm, preferably at least about 2 mm, more preferably at least about 5 mm.

A top piece 120 having the previously described protruding and recessed regions can be made of a substantially transparent plastic via injection molding or any other suitable process known in the art.

In one embodiment, the top piece 120 of the support head 20 is made of at least one of a substantially translucent material and a substantially transparent material which includes a dye, pigment or coloring agent. In one embodiment, the amount or level of dye, pigment or coloring agent is homogeneously incorporated in the material used to make the top piece 120. In order to produce a colored plastic material, a dye or coloring agent is typically added to a predetermined amount of plastic to create a color concentrate or masterbatch of the colored plastic which can then be added to a larger amount of plastic. Non-limiting examples of dye or coloring agent include Rinchrear Masterbatch M92918, M92965 and M92960 available from Richrear Masterbatch Manufacturing Ltd. To Tan Industrial Center 26-28 Au Pui Wan Street Sha Tin New Territories, Hong Kong, P.R. China.

In one embodiment, the amount of dye or coloring agent is added at a level of at least about 0.1 kg, preferably at least about 0.5 kg, more preferably at least about 1 kg per kg of the end material used to make the top piece 120.

Without intending to be bound by any theory, it is believed that when a first substantially transparent region has a greater thickness than a second substantially transparent region, the first region will appear "darker" than the second region when the support head is exposed to a source of light, because more light is absorbed by the thicker region. This light absorption phenomena is better known as the "Beer-Lambert Law".

Figure 5:
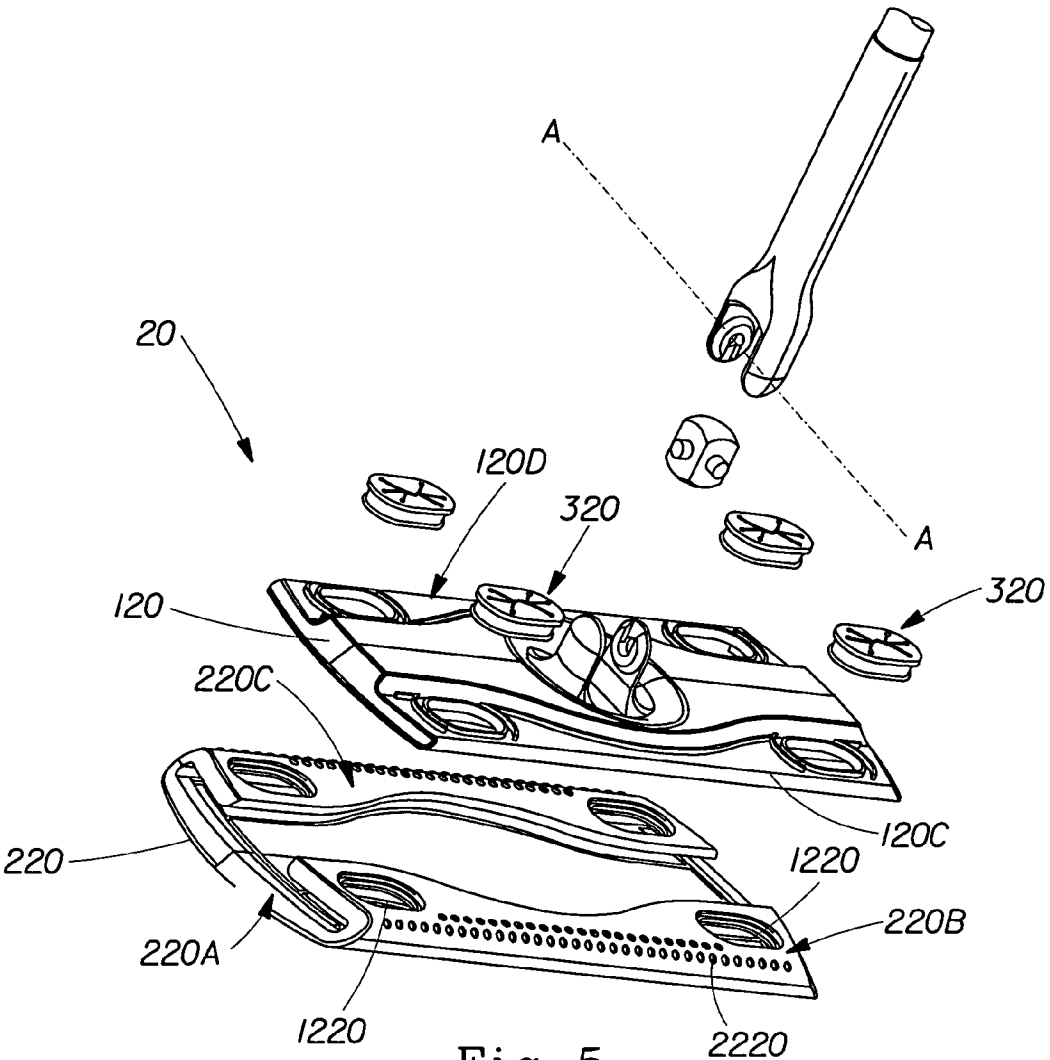
FIG. 5 is an isometric exploded view of a support head.

FIG. 5 shows an exploded view of the support head 20.

In one embodiment of the invention, the top piece 120 of the support head 20 includes a leading region 120C and a trailing region 120D and the lower piece 220 includes a bottom region 220A and an upper leading region 220B. In one embodiment, the lower piece includes an upper trailing region 220C.

In one embodiment, the lower piece 220 is attached to the top piece 120 such that the bottom region 220A is located under the inner surface 120A of the top piece 120 and the upper leading region 220B is located on top of the leading region 120C of the top piece 120 such that the leading region 120C is in between the bottom region 220A and the upper leading region 220B of the lower piece 220.

In one embodiment, the upper trailing region 220C is located on top of the trailing region 120D of the top piece 120 such that the trailing region 120D is in between the bottom region 220A and the upper trailing region 220C of the lower piece 220.

Figure 6A:
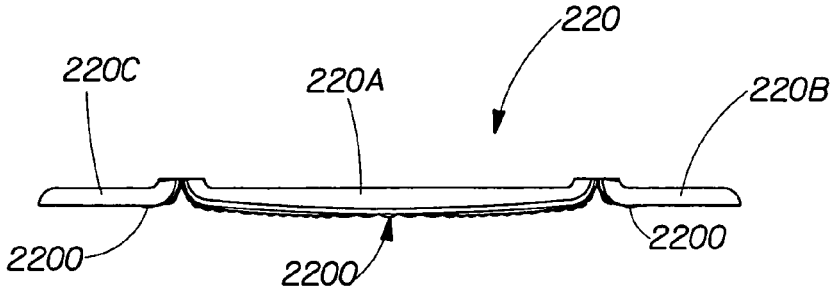
FIG. 6A is a side view of a lower piece of a support head.
Figure 6B:
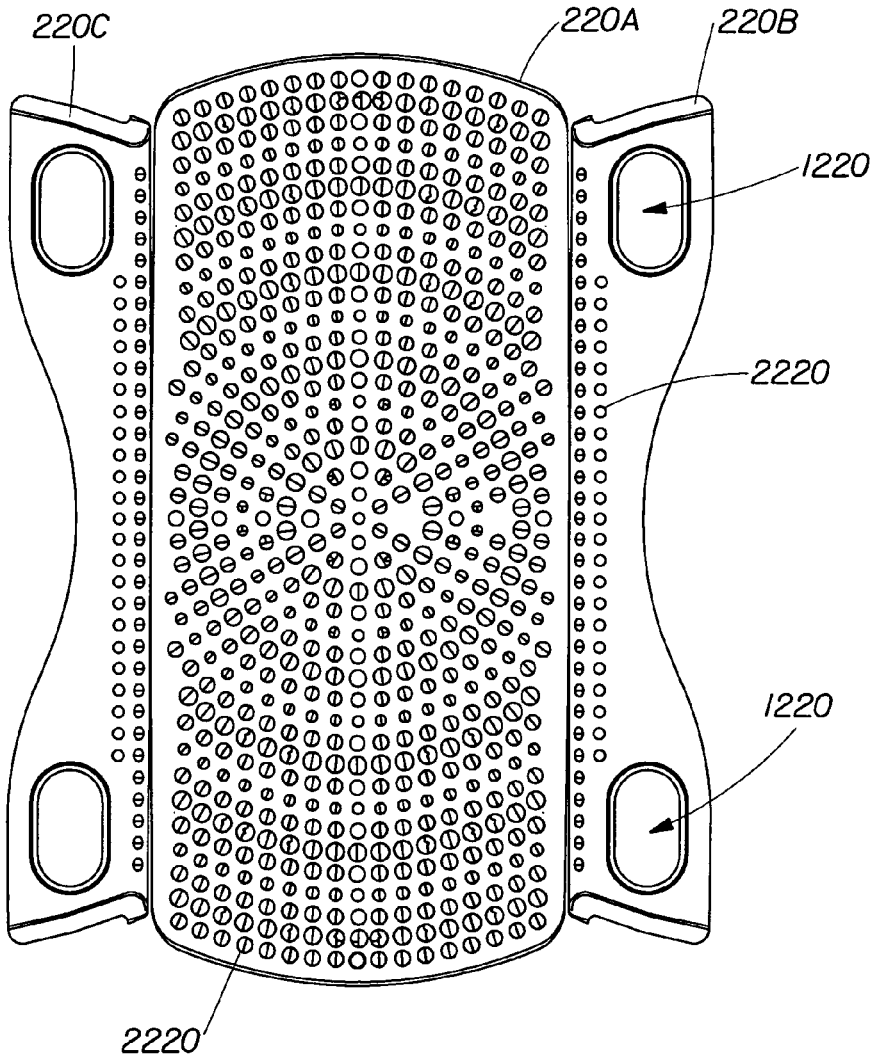
FIG. 6B is a bottom view of a lower piece of a support head.

FIGS. 6A and 6B respectively show a side view and a bottom view of one embodiment of a lower piece 120 having a bottom region 220A, an upper leading region 220B and an upper trailing region 220C before the lower piece 220 is attached to the top piece 120. In this embodiment, the bottom region 220A is connected to the upper leading region 220B and to the upper tailing region 220C. In one embodiment, the upper leading and tailing regions 220B and 2200 are flexibly or hingeably connected to the bottom region 220A such that the upper leading and trailing regions 220B and 220C can be "folded" on top of the corresponding leading and trailing regions 120C and 120D of the top piece 120.

It will be appreciated that the upper leading and trailing regions 220B, 220C can also be formed independently from the bottom region 220A and then attached separately to the top piece 120 and still provide the same benefits.

In one embodiment, the upper leading region 220B includes at least one but preferably two openings 1220 for allowing attachment structures 320 useful for retaining a cleaning substrate to be connected to the top piece 120. In one embodiment, the upper trailing region 220C includes at least one but preferably two openings 1220 for allowing attachment structures 320 to be connected to the top piece 120. The attachment structures 320 can be any slitted structures which are known in the art. Non-limiting examples of suitable attachment structures are disclosed in U.S. Pat. No. 6,651,290 to Kingry et al. issued Nov. 25, 2003 and assigned to The Procter & Gamble Company.

One skilled in the art will understand that when a cleaning substrate is attached to the support head 20, the portion of substrate located in between the attachment structures of the leading or trailing portions can be used to clean a surface by "flipping" or "tilting" the support head and contacting the surface to be cleaned with the portion of cleaning substrate located in between the attachment structures of the leading or trailing portions.

A support head having an upper leading and/or trailing regions can be used safely against any surface to be cleaned since the compressible upper leading and/or trailing regions act as a "bumper", which conforms to the shape of the surface being cleaned.

In one embodiment, the lower piece 220 includes a plurality of projections 2220 creating a pattern of projections. In one embodiment, the upper leading and/or trailing regions include a plurality of the projections 2220.

In one embodiment, the projections 2220 have a height of at least about 0.5 mm, preferably at least about 1 mm, more preferably at least about 1.5 mm and even more preferably at least about 2 mm.

It is believed that the projections 2220 act as pressure points or "fingers" capable of dislodging dust or dirt located in for example grout lines on a ceramic tile floor surface by applying localized pressure on the cleaning substrate.

The lower piece 220 can be attached to the top piece 120 via any method known in the art such as adhesively attached.

The lower piece 220 can be thermo-formed via the following process. A piece of Ethylene Vinyl Acetate foam of is out from a larger sheet into a single piece, which is slightly larger in length, width and thickness than the finished part. This Ethylene Vinyl Acetate piece can be heated in an oven to its processing temperature and then transferred to a compression mould having two halves that have the reverse or negative impression of the shape of the finished lower piece. The mould is closed onto the Ethylene Vinyl Acetate piece, compressing it sufficiently such that the Ethylene Vinyl Acetate foam fills the cavity of the mould and takes the desired shape. It is then allowed to cool to a stable ambient temperature and then removed from the mould.

In one embodiment, the support head 20 is rotatably connected to a handle 30 via a universal joint 40 (which is shown in FIGS. 3 and 5). The universal joint 40 includes a yoke member 140 (shown separately in FIGS. 7A and 7B) that is pivotably connected to the support head 20 about a first pivot axis A—A. The yoke member 140 is operably connected to the lower end of the handle 30.

It is observed that some users, who use a cleaning implement having a yoke member 140 and/or the handle 30 that is made of a plastic material as opposed to for example metal, do not consider either consciously or unconsciously that the yoke member and/or the handle are capable of sustaining a great amount of force during the cleaning operation. As a result, the users of such a cleaning implement may refrain from applying an amount of force to the handle, which would increase the cleaning efficacy of the implement used in combination with a cleaning substrate. Although it is possible to design and manufacture a yoke member and/or a handle made of a plastic material capable of sustaining the rigors of a normal cleaning operation, it can be beneficial to convey to the user that he or she can safely apply a greater amount of force without risking that the yoke member, the handle and/or any other part of the cleaning implement may break or be damaged during use. As some users associated the visual appearance of the yoke member and/or handle with its strength, it is believed that the cleaning efficacy of a cleaning implement can be increased by providing a yoke member and/or handle made of a substantially transparent material and having an appearance other than plastic such as for example the appearance of metal.

Figure 7B:
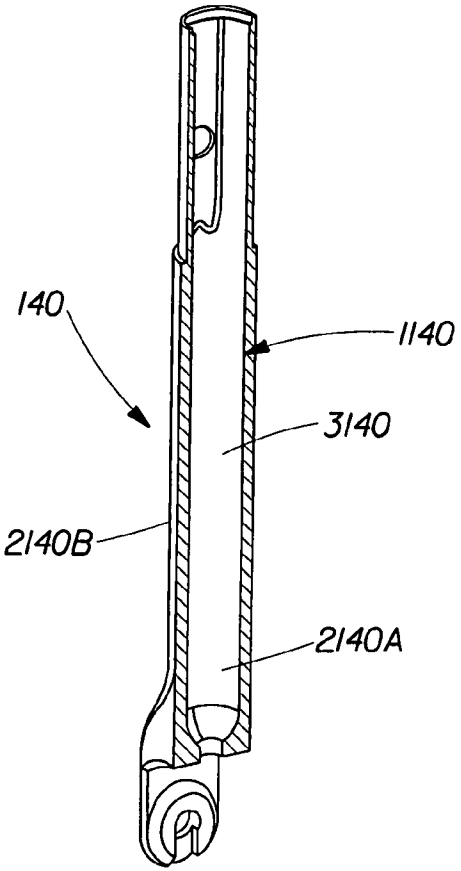
FIG. 7B is a cross-sectional view of the yoke member of FIG. 7A.
Figure 7A:
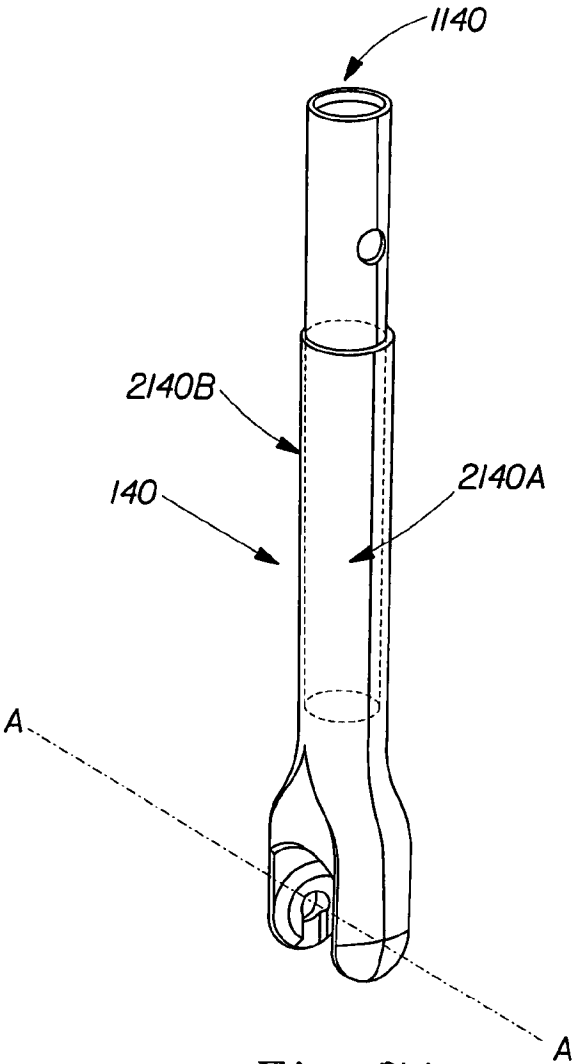
FIG. 7A is an isometric view of a yoke member having a substantially opaque inner surface.

FIG. 7A shows a schematic representation of a yoke member 140 having an inner surface whose appearance is different than the appearance of the outer surface of the yoke member.

FIG. 7B shows an isometric cross-section of the yoke member 140 of FIG. 7A.

In one embodiment, the yoke member 140 is made of a substantially transparent material and includes a cavity 1140 extending along the longitudinal axis of the yoke member. The cavity 1140 provides the yoke member 140 with an inner surface 2140A, which is visually discernable from the outer surface 2140B through the thickness of the yoke member when a user is looking at the yoke member. Without intending to be bound by any theory, it is believed that the inner surface is visually discernable due to the curvature of the yoke member generating a "prism effect."

Although the inner surface 2140A is discernable by a user, its overall appearance does not differ sufficiently from the appearance of the outer surface 2140B to convey to a user that the yoke member is capable of enduring a great amount of force.

In one embodiment, at least a portion of the inner surface 2140A of the yoke member 140 is at least substantially translucent (i.e. not substantially transparent) and preferably substantially opaque in order to provide this portion of the inner surface with a contrasting appearance relative to the outer surface 2140B of the yoke member. In one embodiment A portion or the entire inner surface 2140A of the yoke member can be rendered substantially translucent or opaque by texturing the inner surface and/or by adding a coating 3140 (such as a paint) to the inner surface, which allows a user to further distinguish the inner surface 2140A from the outer surface 2140B of the yoke member due to the contrasting appearance of the inner surface. The inner surface of the yoke member can be textured by making "micro-scratches," which cause the light to be diffracted.

When the inner surface of the yoke member is rendered substantially translucent of opaque by the addition of a coating 3140, the coating is preferably thick enough to produce the desired visual effect. In one embodiment, the coating has a thickness of between about 0.05 mm and about 2 mm, preferably between about 0.1 mm and about 1.5 mm, more preferably between about 0.25 mm and about 1 mm. In one embodiment, the inner surface of the yoke member is "modified" in order to provide the inner surface with a substantially opaque metallic appearance. In a preferred embodiment, the inner surface of the yoke member is coated with a material comprising metallic particles in order to mimic the presence of a metal part inside the yoke member.

The inner surface (or any portion thereof) of the yoke member can be coated with a material having an appearance other than the appearance of the outer surface via any method known in the art.

In one embodiment, the inner surface 2140A is spray-painted with a material having a metallic appearance such that the substantially transparent yoke member appears to have a section made of metal located inside the yoke member.

In one embodiment, the inner surface of the yoke member and/or the handle is coated with a material which is substantially translucent or opaque such that the appearance is substantially continuous between the yoke member and the handle when the yoke member is attached to the lower end of the handle 30.

In one embodiment, a layer of a substantially translucent or opaque material is inserted within the cavity 1140 such that a user can visually distinguish the appearance of this layer by transparency through the transparent yoke member.

In one embodiment, the cavity 1140 can be substantially filled with a substantially translucent or opaque material which preferably has a contrasting color relative to the color of the yoke member such that a user can visually distinguish the appearance of contrasting material by transparency through the transparent yoke member.

Although the coating, layer of material and/or contrasting material do not provide any significant structural reinforcement to the yoke member, a user who is able to distinguish the coating, layer and/or contrasting material associates its visual appearance with a greater strength of the yoke, and ultimately, a greater strength of the cleaning implement.

Without intending to be bound by any theory, it is believed that a user, who can distinguish the inner surface of the yoke member because it has an appearance other than the appearance of the outer surface of the yoke member, associate this appearance (in particular a metallic appearance) with a greater strength. Because of this association, a user applies a greater amount of force to the handle during the cleaning operation. As a user applies more force to the handle, the cleaning efficacy of the implement used with a cleaning substrate is increased.

It will be appreciated that other portions of the cleaning implement (i.e. the handle and/or hand-grip), and preferably longitudinal members having a cavity has previously discussed, can be made of a substantially transparent plastic material, which includes an inner surface whose appearance is different from the appearance of the outer surface in order to provide the desired contrasting visual appearance that conveys a greater strength of the implement.

Figure 8:
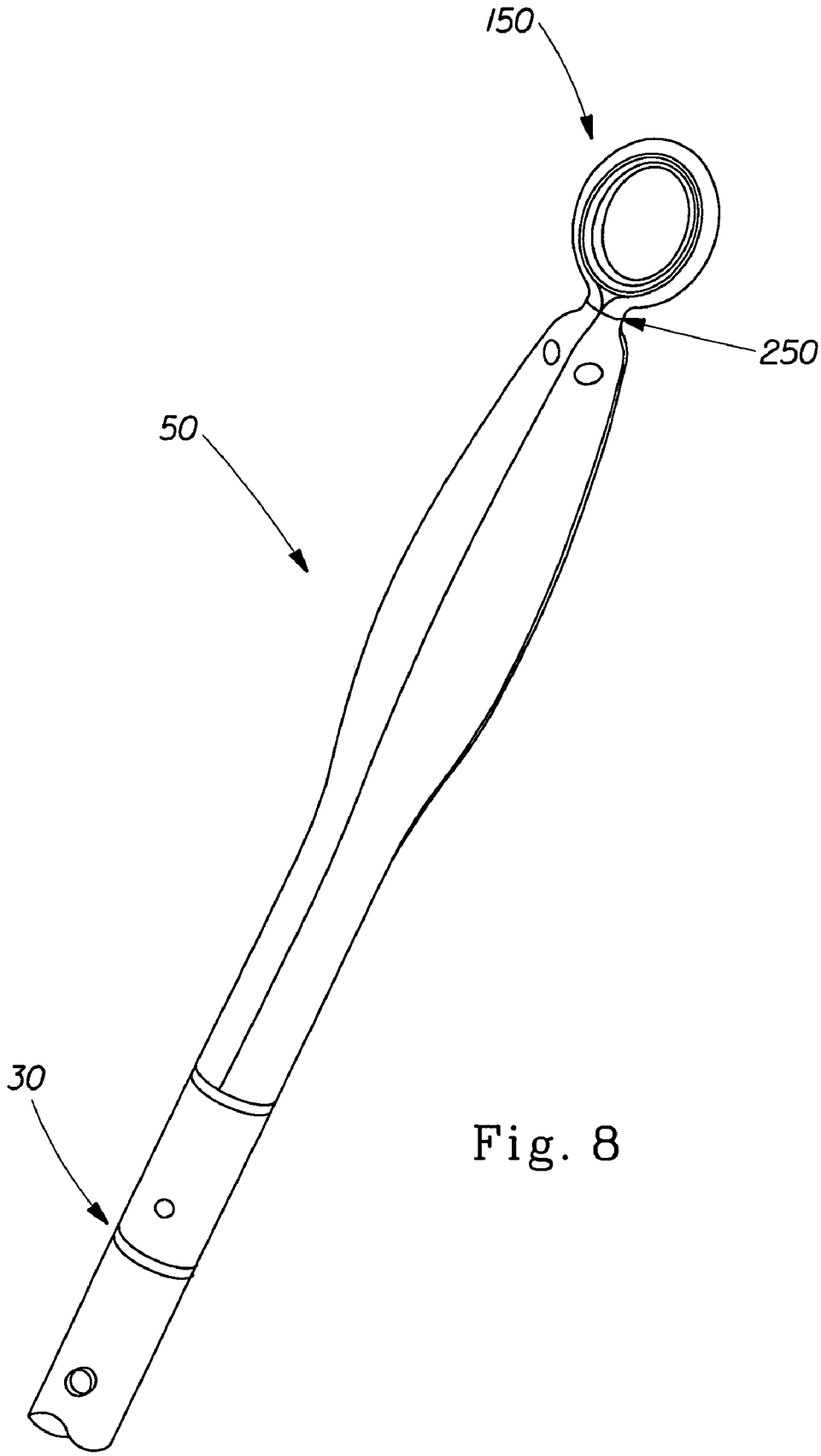
FIG. 8 is an isometric view of a hand-grip portion of a cleaning implement.

In one embodiment shown in FIG. 8, the cleaning implement includes a hand-grip portion 50 that is connected to the upper end of the handle 30.

The hand-grip portion can have a ring portion 150 that is useful to hang the implement for example to a hook when the implement is not being used.

The ring portion 150 can be operably and flexibly connected to the upper end of the hand-grip portion such that the ring portion 150 can move relative to the hand-grip portion 50 when a force is applied to the ring portion 150.

In one embodiment, the ring portion 150 is operably and flexibly connected to the hand-grip portion via a neck portion 250 joining the hand-grip portion to the ring portion.

In another embodiment, the ring portion can be operably and flexibly connected to the hand-grip portion via a spring.

In a preferred embodiment, the neck portion 250 can be made of a deformable and elastic material in order to allow the ring portion to move relative to the hand-grip portion.

In a preferred embodiment, at least part of the ring, neck and hand-grip portions are formed together in the form of an integral piece.

Non-limiting examples of suitable deformable and elastic material include thermo-plastic rubber, thermo-plastic elastomer, and mixtures thereof.

One skilled in the art will understand that when a user accidentally releases or drops the hand-grip portion, the handle and hand-grip portion can fall by gravity towards a surface such as a wall. During the fall of the handle, the ring portion is the most likely to contact a wall and potentially damage the wall surface. A ring-portion that is flexibly connected to the hand-grip portion reduces the chances that the wall surface may be damaged as part of the energy is absorbed and/or dissipated by the deformation of the neck portion.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A support head for a cleaning implement, said support head having two opposed longitudinal edges, and comprising:

a top piece comprising at least one protruding region and one recessed region wherein said protruding region and said recessed region are made of at least one of a substantially translucent material and a substantially transparent material such that said protruding region produces a visible shadow zone and a visible bright zone on a surface located underneath said top piece when light passes through said protruding region, said support head further comprising:

a top piece having a leading region and a trailing region;

a yoke for receiving a handle; and a lower piece having a bottom region and an upper leading region wherein said lower piece is attached to said top piece such that said leading region of said top piece is located in between said bottom region and said upper leading region of said lower piece and wherein said lower piece is made of a substantially a substantially compressible nonabsorbent material, said substantially compressible nonabsorbent material wrapping both said longitudinal edges and to be disposed within the leading region and trailing region of said top piece, but not be disposed in said yoke, whereby said yoke is free of said compressible material.

2. The support head of claim 1 wherein said lower piece comprises an upper trailing region such that said trailing region of said top piece is located in between said bottom region and said upper trailing region of said lower piece.

3. The support head of claim 2 wherein said substantially compressible material is substantially elastic.

4. The support head of claim 1 wherein said upper leading region comprises at least one opening and said support head comprises at least one attachment structure for retaining a cleaning substrate about said support head and wherein said attachment structure is accessible from said opening, said attachment structure being disposed within said compressible material.

5. The support head of claim 1 wherein said top piece is rotatably connected to a handle.

* * * * *

UNITED STATES PATENT AND TRADEMARK OFFICE

CERTIFICATE OF CORRECTION

PATENT NO. : 7,565,715 B2
APPLICATION NO. : 11/403396
DATED : July 28, 2009
INVENTOR(S) : Harper et al.

It is certified that error appears in the above-identified patent and that said Letters Patent is hereby corrected as shown below:

Column 9

Line 23, delete "tailing" and insert --trailing--.

Line 24, delete "tailing" and insert --trailing--.

Line 24, delete "2200" and insert --220C--.

Column 10

Line 6, delete "out" and insert --cut--.

Signed and Sealed this

Thirteenth Day of April, 2010

David J. Kappos

David J. Kappos
*Director of the United States Patent and Trademark Office*